US010663219B2

(12) United States Patent
Alyanak et al.

(10) Patent No.: US 10,663,219 B2
(45) Date of Patent: May 26, 2020

(54) HOUSEHOLD COOLING APPLIANCE CONTAINING A DISPENSER UNIT FOR LIQUID AND/OR FREE FLOW REFRIGERATED GOOD

(71) Applicant: BSH HAUSGERAETE GMBH, Munich (DE)

(72) Inventors: Altan Alyanak, Istanbul (TR); Volkan Cakirca, Istanbul (TR); Mehmet Ciyanoglu, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 273 days.

(21) Appl. No.: 15/652,303

(22) Filed: Jul. 18, 2017

(65) Prior Publication Data

US 2018/0023886 A1 Jan. 25, 2018

(30) Foreign Application Priority Data

Jul. 19, 2016 (TR) ..... a 2016 09939

(51) Int. Cl.

| | |
|---|---|
| ***F25D 31/00*** | (2006.01) |
| ***F25D 23/12*** | (2006.01) |
| ***F25C 5/20*** | (2018.01) |
| ***B67D 3/00*** | (2006.01) |

(52) U.S. Cl.

CPC ..... *F25D 31/002* (2013.01); *B67D 3/009* (2013.01); *F25C 5/22* (2018.01); *F25D 23/126* (2013.01); *F25C 2500/06* (2013.01)

(58) Field of Classification Search

CPC ..... F25D 31/002; F25D 23/126; F25C 5/22; F25C 2500/06; B67D 3/009

USPC ..... 62/389

See application file for complete search history.

(56) References Cited

U.S. PATENT DOCUMENTS

| | | | | |
|---|---|---|---|---|
| 4,783,971 | A * | 11/1988 | Alba | F25D 21/14 248/225.11 |
| 8,122,734 | B2 | 2/2012 | Buchstab et al. | |
| 8,966,927 | B2 | 3/2015 | Eckartsberg et al. | |

(Continued)

FOREIGN PATENT DOCUMENTS

| | | | |
|---|---|---|---|
| WO | 2007118787 | A1 | 10/2007 |
| WO | 2009080635 | A2 | 7/2009 |
| WO | 2009110674 | A1 | 9/2009 |

*Primary Examiner* — Steve S Tanenbaum

(74) *Attorney, Agent, or Firm* — Laurence A. Greenberg; Werner H. Stemer; Ralph E. Locher

(57) ABSTRACT

A household cooling appliance has a dispenser unit for dispensing a free flow refrigerated good. The dispenser unit has an insert, which by side walls and a bottom wall bounds a niche, in which a receptacle for receiving the free flow refrigerated good is insertable. A drip tray is provided, which is separate from the insert, for collecting liquid and can be brought into the niche. The drip tray has a drip well and a grip element which extends within the drip well and is accessible from the top for gripping. The drip tray on a bottom wall has a liquid distribution element, which elevated from the top side protrudes upwards and is configured to be narrowing. The drip tray on the bottom wall has a coupling element which for positioning of the drip tray is formed in the insert for coupling with a counter coupling element.

12 Claims, 5 Drawing Sheets

(56) References Cited

U.S. PATENT DOCUMENTS

| | | | | |
|---|---|---|---|---|
| 2007/0283817 | A1* | 12/2007 | Fugger | A47J 31/4428 99/290 |
| 2013/0160481 | A1* | 6/2013 | Hasturk | F25D 23/126 62/391 |

* cited by examiner

HOUSEHOLD COOLING APPLIANCE CONTAINING A DISPENSER UNIT FOR LIQUID AND/OR FREE FLOW REFRIGERATED GOOD

CROSS-REFERENCE TO RELATED APPLICATION

This application claims the priority, under 35 U.S.C. § 119, of Turkish application TR 2016/09939, filed Jul. 19, 2016; the prior application is herewith incorporated by reference in its entirety.

BACKGROUND OF THE INVENTION

Field of the Invention

The invention relates to a household cooling appliance having a dispenser unit, which is configured for dispensing a liquid and/or a free flow refrigerated good. The dispenser unit has an insert, which by walls bounds a niche. Into the niche a receptacle can be inserted for receiving the liquid and/or the free flow refrigerated good to be dispensed. The dispenser unit moreover has a drip tray, which is separate from the insert, for collecting liquid that can be inserted into the niche, wherein the drip tray has a drip well.

Household cooling appliances for storing and preserving food items are known from the prior art. It is also known that such appliances in a door closing a receiving space for food items contains a dispenser unit or an output unit for liquid and/or free flow refrigerated good, such as for instance ice cubes or crushed ice. Also with the door being closed thus the dispenser of this liquid or this free flow refrigerated good is facilitated. For instance from international patent disclosure WO 2009/080635 A2 (corresponding to U.S. Pat. No. 8,966,927) a corresponding dispenser unit is known.

Moreover from international patent disclosure WO 2007/118787 A1, corresponding to U.S. Pat. No. 8,122,734, a household cooling appliance containing a corresponding dispenser device is known. In this design moreover on the front side of the door an additional decorative plate, for instance a furniture front plate, which is separate therefrom, is arranged. This furniture front plate contains a hole or a recess, by which the dispenser unit or a niche of this dispenser unit is also accessible. The dispenser unit in this design is also attached to the decorative plate.

Moreover, from international patent disclosure WO 2009/110674 A1 a corresponding dispenser unit is known, which additionally also has an electronics module. The electronics module contains control elements and moreover also has a display unit. Further, a separate drip tray can there be inserted into the niche. The drip tray, however, is arranged to rest only on a bottom side and is held magnetically at the rear portion to a rear wall. The drip tray integrated as a cover has a grid.

In the known design the drip tray is easily shifted out of position. The handling of the drip tray is not very convenient for the user and liquid dripping in splashes up again in an undesired way so that also portions of the niche are moistened in an undesired way by the splashing liquid.

SUMMARY OF THE INVENTION

It is the task of the present invention to provide a household cooling appliance, in which the suitability of the drip tray of the dispenser unit is improved. In particular in this connection it is the task to provide a drip tray, which is easier to handle for a user and thus with regard to removal and insertion of the drip tray from the niche and into the niche is improved. In particular it is also the task not to allow for the liquid dripping in to splash out again in an undesired way. Moreover, it is the task of the instant invention to arrange the drip dray of the dispenser unit in a secure position within the niche.

These tasks are solved by household cooling appliances having the features according to the independent claims.

According to a first independent aspect of the invention a household cooling appliance with a dispenser unit for dispensing a liquid and/or free flow refrigerated good is configured. The dispenser unit, which can also be referred to as output unit, contains a separate insert, which by vertical side walls and a bottom wall bounds a niche. This niche is freely accessible and into this niche a receptacle for receiving the liquid and/or the free flow refrigerated good dispensed can be inserted. The dispenser unit moreover contains a drip tray, which is separate from the insert and which is configured for collecting liquid dripping or draining into the niche. The drip tray contains a drip well.

An essential idea of the invention is to be seen in that the drip tray has a grip element, which extends within the drip well and is accessible from the top for gripping. By such a design the drip tray is easier to be handled by a user, since the removal from the, in particular box-shaped or tray-like, insert or the insertion into the insert is more targeted. Since the drip tray preferably is shaped to fit the side walls relatively precisely, by the now provided grip element the drip tray can be easily grasped and removed in a targeted way, even if it is arranged in its end position in the insert. A difficult removing of the drip tray, which involves major mounting effort, possibly with the aid of an auxiliary tool, is no longer required. By the position of the grip element same is also arranged correspondingly flush-mounted so that it does not protrude in an undesired way and does not impair the insertion of a receptacle into the niche.

In particular the grip element is integrated and thus integrally formed with the drip tray.

In an advantageous embodiment of the invention it is envisaged that the grip element is T-shaped. This individual shape design is particularly advantageous for the gripping with two fingers, in particular with the forefinger and the thumb of a hand. On the one hand, thereby the gripping with these two fingers can easily be performed on the T-stem, on the other hand by the T-roof and thus by the top horizontal bar a kind of stop for the finger is formed so that an undesired slipping off is prevented. Moreover, by this shape then by the T-roof also a kind of lever stop can be provided, by which then also when performing a pivoting movement for lifting the drip tray out of the niche an element can be provided, which supports this corresponding counter pressure and the conversion of the lever effect.

Preferably it is envisaged that the T-shape is arranged prostrated. This means that the T-stem extends towards a sidewall of the drip well and the T-roof is orientated towards the interior of this drip well. The above-named advantages are once again enhanced thereby.

Preferably it is envisaged that a T-roof of the T-shape is arranged to face a rear boundary wall laterally bounding the drip well and facing away from a niche opening of the niche. Thus the grip element is positioned in such a way that a user does not need to reach far into the niche in order to reach the grip element. Moreover, by this arrangement also the pivoting movement of the drip tray towards the front, as already named in the above, is achieved in particular for removal of the insert in a particularly advantageous way.

Preferably it is envisaged that the grip element is arranged to protrude from a front boundary wall laterally bounding the drip well and facing a niche opening of the niche into the drip well. By this design it is also linked in a mechanically stable way to the drip well and moreover also arranged correspondingly stable on the bottom of the drip well and thus also of the drip tray. The grip element therefore is also designed to be highly resistant to deformation and can without any problems absorb corresponding forces that occur for instance when gripping or removing by way of a pivoting movement.

Preferably the grip element is integrally formed with the lateral boundary wall. Thereby a number of components is reduced and the mounting effort required is reduced to a minimum. Moreover, the position of the grip element is kept precisely for good.

Preferably it is envisaged that the grip element is integrally formed with a bottom wall bounding the drip well. Here, too, the already named advantages apply in analogy.

Preferably it is envisaged that the grip element viewed across its entire height is arranged within the drip well. Thereby, on the one hand it has a corresponding size to be securely grasped by a user, on the other hand, it does not protrude in an undesired way upward so that it is prevented from being hit by a hand or a collection receptacle.

In particular it is envisaged that the drip well and the grip element are covered by a cover grid that can be removed from the drip tray and that is separated from it. Thereby, the grip element is covered in the unrequired state and is arranged in the volume portion that is formed by the drip well and the cover by the cover grid from the above. Thus, setting up a collection receptacle on the cover grid then is not hindered.

Preferably it is envisaged that the drip tray on the bottom side of a bottom wall of the drip well contains at least one coupling element, which is configured for positioning the drip tray within the insert for coupling with a counter coupling element on the insert. By such a design the secure position of the drip tray within the insert is raised once again. In this connection it is in particular envisaged that the insert contains a kind of recess, into which the drip tray can be inserted. Thus the drip tray is not only arranged with its bottom wall on an even set-up wall of the insert. A simple sliding of the drip tray towards the front or towards the side relative to the insert is thereby prevented.

Even if a collection receptacle is set up on the drip tray and in the set-up state is jerkily drawn to the front, an undesired release of the drip tray from the insert is avoided. A sliding of the drip tray towards the front, which is then caused in an undesired way, is prevented by the advantageous embodiment of the invention.

Preferably it is envisaged that the drip tray at the top side of a bottom wall of the drip well contains at least one liquid distribution element, which elevated from the top side protrudes upward and is configured to be narrowing from the top side upwards. This is a very advantageous embodiment insofar as thus drops of liquid from a dispenser socket of the dispenser unit do not splash onto a horizontal plane and there splash up again in an undesired way, but that these drops in a targeted way due to this specific geometry and the local position of the liquid distribution element quasi are increased with regard to their surface and run further down in a targeted way and are correspondingly slowed down so that when reaching the remaining top side of the bottom wall they then no longer hit it with such an impetus that they would splash up again in an undesired way.

A further independent aspect of the invention relates to a household cooling appliance containing a dispenser unit for dispensing a liquid and/or free flow refrigerated good. The dispenser unit contains an, in particular box-shaped or tray-like insert, into which a receptacle for receiving the liquid to be dispensed and/or the free flow refrigerated good can be inserted. This means that, when dispense is desired, this receptacle can be inserted into the niche and then by activation of the dispenser unit the liquid and/or the free flow refrigerated good is dispensed via a dispenser arranged in the upper portion by opening the dispenser unit and from there reaches the receptacle. The dispenser unit has a drip tray that is separate from the insert and is configured for collecting liquid that drips or runs into the niche. By the drip tray liquid dripping down from the dispenser opening of the dispenser unit or running from a wall of the niche is contained or collected.

An essential idea of the invention is to be seen in that the drip tray on a top side of a bottom wall of the drip well contains at least one liquid distribution element, which elevated from the top side protrudes upward and is configured to be narrowing from the top side upwards. When liquid enters or drips into the drip tray from the top by this design an undesired strong hitting of this liquid upon the top side of the bottom wall and thus also an undesired strong splashing back again of this liquid is avoided by this design. By this specific liquid distribution element the liquid that drips in is received in a targeted way, is preferably enlarged in surface, and drained in a targeted way towards the top side of the bottom wall, wherein then correspondingly it is also slowed down to a certain extent so that, when hitting the top side of the bottom wall, it no longer has so strong an impetus that an undesired splashing up would occur.

Preferably it is envisaged that the liquid distribution element is configured as a cone. A corresponding rotationally symmetrical design of the liquid distribution element fulfils the above-named advantages to a particular extent.

In a further advantageous embodiment it can also be envisaged that the liquid distribution element is configured as a pyramid. Equally as well, however, a design in the form of a triangular prism can be envisaged or in the case of a design as a pyramid same can be configured to be four-sided, five-sided, six-sided, or even comprise more sides. The liquid distribution element can also be a tetrahedron.

In general the geometry of the liquid distribution element can also be designed in many other ways, however it is in particular envisaged that the liquid distribution element on the side facing away from the top side of the bottom wall has a tip. By this tip the entering liquid in the form of the drops is correspondingly distributed and directed downwards.

In particular it is envisaged that the liquid distribution element is designed to be adjacent to a grip element reaching into the drip well on the bottom wall. By this immediately adjacent arrangement also the stability of the elements can be raised.

A further independent aspect of the invention relates to a household cooling appliance containing a dispenser unit for dispensing a liquid and/or free flow refrigerated good. The dispenser unit or output unit contains an insert, which by side walls and a bottom wall bounds a niche. The niche is accessible at the front side and is configured for receiving or inserting a receptacle for receiving the liquid to be dispensed and/or the free flow refrigerated good. In this niche ends in particular also a dispenser opening of the dispenser unit in particular in a niche roof. The dispenser unit besides the insert contains a drip tray for containing liquid, which is separate therefrom and can be inserted into the niche. The drip tray contains a drip well.

An essential idea of the invention is to be seen in the fact that the drip tray on a bottom side of a bottom wall of the drip well contains at least one coupling element, which is configured for positioning the drip tray in the insert for coupling with a counter coupling element arranged on the insert. By such a design the more reliable and more securely positioned attachment of the drip tray within the insert, in particular in the region of a bottom of the insert, is improved. An undesired sliding from the drip tray is thereby prevented. A simple horizontal drawing out in the depth direction of the household cooling appliance of the drip tray from the insert is therefore no longer possible. Even if thus on the drip tray a receptacle is put up, which in the put up state is meant to be taken out towards the front and thus meant to be removed from the niche, an undesired sliding of the drip tray towards the front, which is involved with it, is prevented.

Preferably the insert in the bottom portion contains a tray-like design, into which a drip tray can be inserted.

Preferably the coupling element, which is integrally formed on the bottom wall of the drip well, is a recess.

By such a design a targeted and reliably achievable coupling with the counter coupling element can be achieved when inserting the drip tray into the insert. The counter coupling element then automatically plunges into this recess so that the recess quasi like a hood surrounds the counter coupling element from the top.

Preferably it is envisaged that the counter coupling element is a coupling pin protruding from a bottom wall of the insert towards the top.

Preferably it is envisaged that the coupling connection between the coupling element and the counter coupling element is a plug-in connection, which, on the one hand, is easy to establish and releasable, on the other hand, though, allows for a reliable and securely positioned coupling.

Preferably it is envisaged that the counter coupling element is arranged in the portion of a slot formed in the bottom wall of the insert. In particular thus in the bottom wall a slot is formed for draining the liquid from the insert and the counter coupling element is configured on a front end of the slot facing a niche opening of the niche. By this design a simple manufacturing of the insert formed as a single piece is facilitated and a precisely shaped and accurately localized positioning of the counter coupling element within the bottom wall is achieved. On the other hand thereby the slot is not impaired by the counter coupling element, on the contrary, the boundary wall of the slot is stabilized in this very front portion, in particular narrowed portion, of the slot.

Preferably it is envisaged that several coupling elements and several counter coupling elements are configured, which respectively couple with each other in such a way that the positioning of the drip tray in this tray-like receptacle of the insert in the bottom portion of the insert is improved once again.

In particular the household cooling appliance is a rack-mounted model. In particular it can be arranged in a furniture niche of a furniture wall.

With the indications "top", "bottom", "front", "rear, "horizontal", "vertical", "depth direction", "width direction", "height direction" etc. the positions and orientations given for intended use and intended arrangement of the appliance and for a user then standing in front of the appliance and viewing in the direction of the device are indicated.

Further features of the invention derive from the claims, the figures, and the description of the figures. The aforementioned features and feature combinations named in the description, as well as the features and feature combinations named in the following in the description of the figures and/or shown in the figures alone can be used not only in the respective indicated combination, but also in other combinations, without departing from the scope of the invention. Thus also embodiments of the invention are to be considered as comprised and disclosed, which are not explicitly shown and explained in the figures, but by separated feature combinations derived from the explained embodiments and can be generated therefrom. Thus also explanations and feature combinations are to be regarded as disclosed, which thus do not comprise all features of an originally formulated independent claim. Moreover embodiments and feature combinations, in particular by the embodiments set out in the above, are to be considered as disclosed, which go beyond the feature combinations set out in the back-references of the claims or deviate therefrom.

Other features which are considered as characteristic for the invention are set forth in the appended claims.

Although the invention is illustrated and described herein as embodied in a household cooling appliance containing a dispenser unit for a liquid and/or a free flow refrigerated good, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures same elements or elements having the same functions are equipped with the same reference signs.

Figure 1:
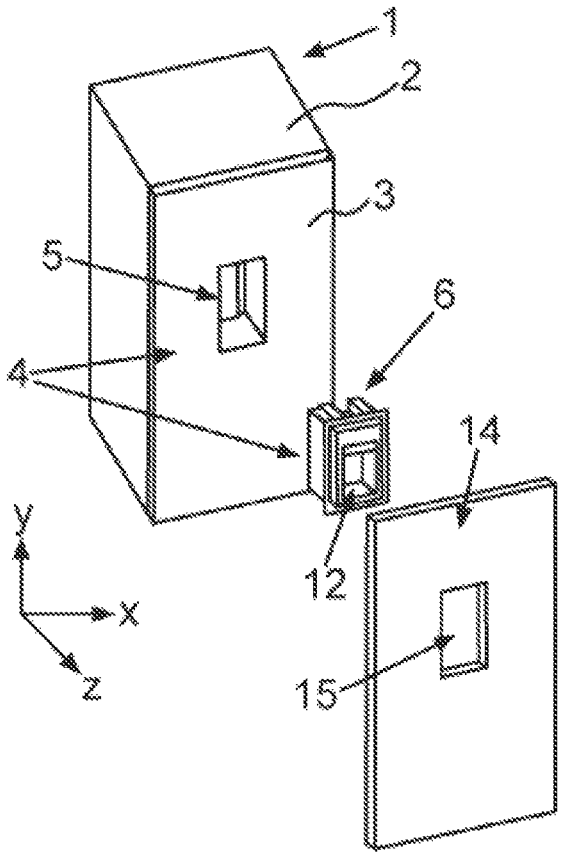
FIG. 1 is a diagrammatic, perspective exploded view of an embodiment of a household cooling appliance according to the invention.

Referring now to the figures of the drawings in detail and first, particularly to FIG. 1 thereof, there is shown in a schematic view a household cooling appliance 1 is shown, which is configured for storing and preserving food items and which for instance can be a cooling appliance, a freezer or a fridge-freezer combination appliance. The household cooling appliance 1 is preferably a rack-mounted model. The household cooling appliance 1 has a housing 2, in which at least one receptacle for food items is configured. The receptacle can be closed at the front by a door 3, which is shown in FIG. 1 in the closed state and which is pivotably arranged on the housing 2. The household cooling appliance 1 has an output unit or dispenser unit 4, which in FIG. 1 merely as an example is equipped with the reference sign, and in which in FIG. 1 individual components are only partly shown. The dispenser unit 4 is configured for dispensing a liquid and/or free flow refrigerated good. Thus, a drink and/or an ice cube form element, for instance ice cubes or crushed ice, can be dispensed.

For this purpose in the shown embodiment for instance the door 3 has a recess 5, into which the dispenser unit 4 is inserted so that in the closed state of the door 3 the dispenser unit 4 is accessible from the front, in order to be able to dispense the liquid and/or the free flow refrigerated good.

The dispenser unit 4 has an insert 6, which is in particular integrally formed from plastic. The insert 6 has several walls 7, 8, 9, 10, and 11 (FIG. 2), which bound a niche 12. The indentation or the niche 12 is configured for receiving or for inserting a receptacle so that then the liquid and/or free flow refrigerated good can be inserted from the top into the receptacle. The niche 12 is accessible from the front. The dispenser unit 4 has a dispenser opening, which ends in particular in a niche ceiling wall 8 and via which the liquid and/or the free flow refrigerated good can be inserted into the niche 12 and there into the receptacle, which has been put in.

The insert 6 moreover has as an example a receptacle 13, which is configured as slot. An electronics module is capable of being inserted into the receptacle 13.

In FIG. 1 moreover also a decorative plate 14 is shown, which is separate from the door 3 and preferably present and which can be a furniture front plate. The decorative plate 14 can preferably be attached to the door 3 and covers same at the front. Also the decorative plate 14 has a recess 15, through which the dispenser unit 6 is accessible on the front side. In particular the dispenser unit 4, in particular the insert 6, is arranged on the decorative plate 14, in particular attached thereon.

Figure 2:
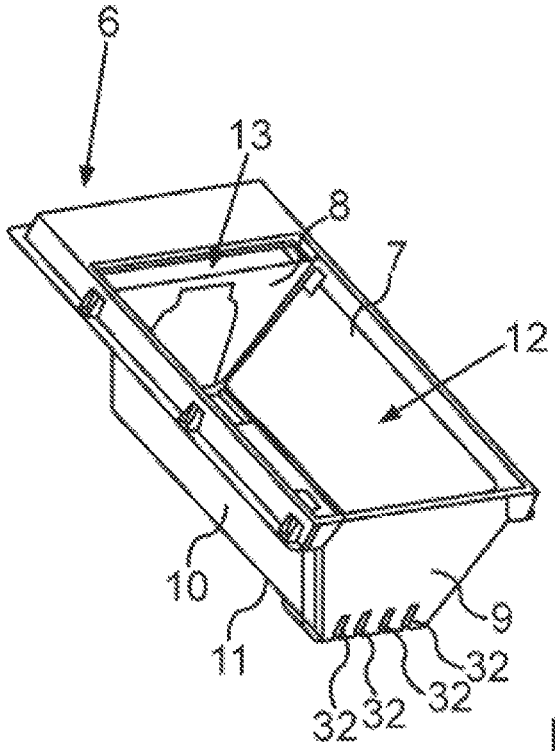
FIG. 2 is a perspective view of an insert of a dispenser unit, which is configured for dispensing liquid and/or free flow refrigerated good and is a component of the household cooling appliance according to FIG. 1.

In FIG. 2 the insert 6 is shown in perspective view.

Figure 3:
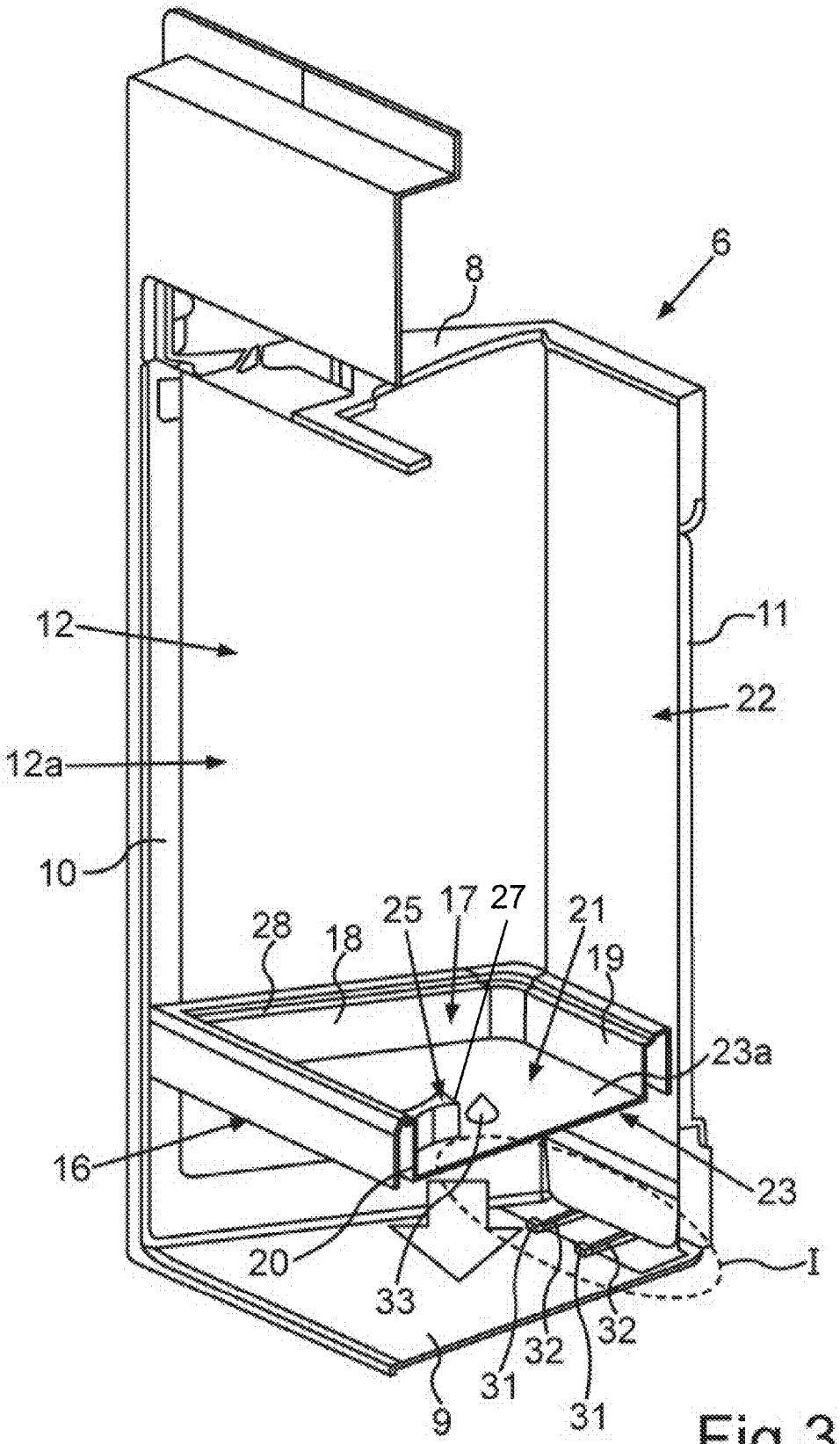
FIG. 3 is a perspective sectional view of the insert according to FIG. 2 having an additionally shown drip tray of the dispenser unit.

In FIG. 3 the insert 6 formed in particular as a single piece from plastic is shown in a perspective sectional view. Moreover, in FIG. 3 a drip tray 16 is shown in a perspective and sectional view, which is configured as a component which is separate from the insert 6. The drip tray 16 is positioned in the niche 12, wherein in FIG. 3 it is not yet shown in its final bottom end position. The drip tray 16 is preferably formed as a single piece made of plastic. It has a drip well 17 open to the top, which is configured to be tray-like and bounded by lateral boundary walls 18, 19, 20, and 21 (FIG. 5). Moreover the drip well 17 has a bottom wall 21. The drip tray 16 in FIG. 4, in which a vertical sectional view of the insert 6 is shown with the drip tray 16 shown then arranged in the insert 6 in the bottom end position, is retained in fixed position. As moreover can be seen in FIG. 3, the dispenser unit 4 in addition to the insert 6 and the drip tray 16 contains a cover that is separate therefrom as a cover 22, which preferably is formed as a single piece, in particular from metal. The cover 22 is inserted into the niche 12 and covers the walls 7, 10, and 11 of the insert 6 at the front at least partly. The separate cover 22 is preferably held on the insert 6, in particular by magnetic retention force.

The cover 22 is adjusted to the trapezoidal design of the walls 7, 10, and 11.

Figure 4:
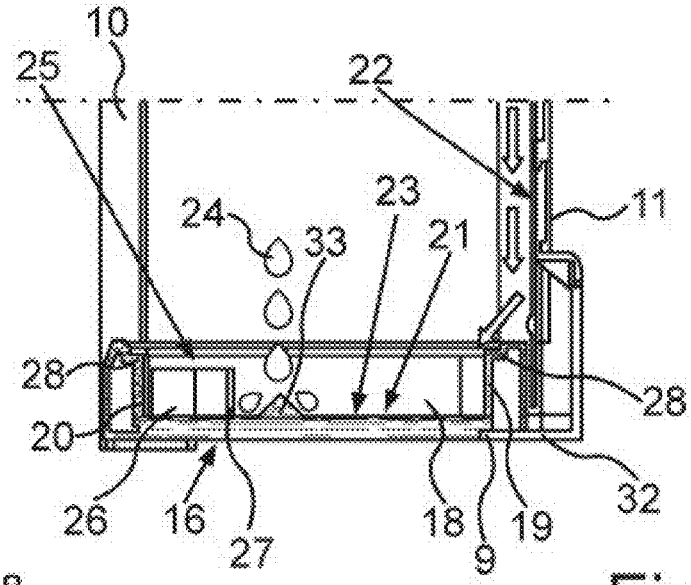
FIG. 4 is a sectional view of the components according to FIG. 3 in the fully inserted state of the drip tray into the insert.
Figure 5:
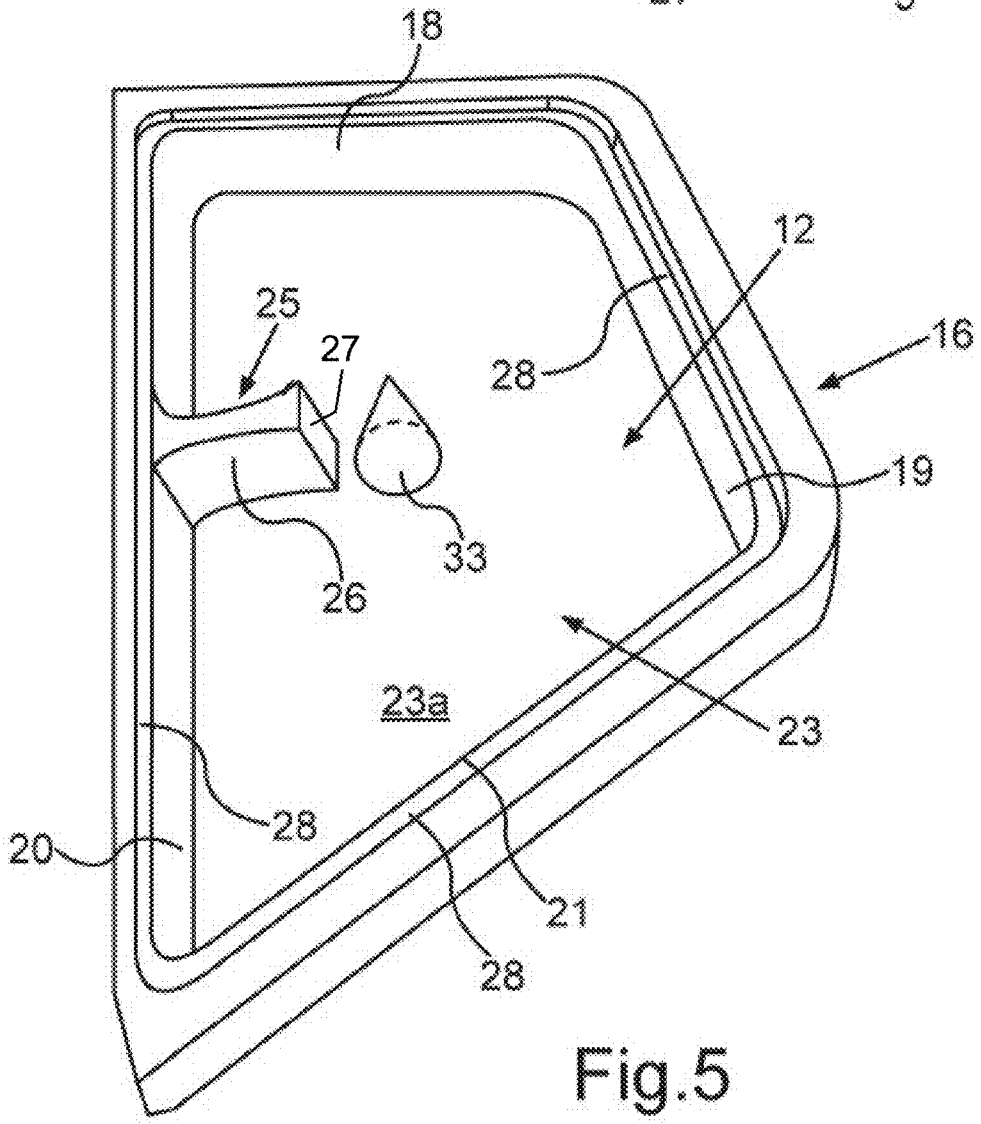
FIG. 5 is a perspective view of an embodiment of a drip tray of the dispenser unit showing a view of a drip well from the top.

As can be seen in FIG. 4, a bottom wall 23 of the drip well 17 has a liquid distribution element 33, which elevated from a top side 23*a* of the bottom wall 23 extends upwards. The liquid distribution element 33 in its height design is smaller than the depth of the drip well 17. Also the extension in the horizontal direction is smaller than the surface size of the top side 23*a*. As can be seen in FIG. 4, the liquid distribution element 33 is configured to be narrowing starting from the top side 23*a* upwards. On its top end facing away from the top side 23*a* it has a tip. In the horizontal plane this liquid distribution element 33 is positioned in such a way on the top side 23*a* that liquid 24 dripping into the drip well 17 from the top hits this liquid distribution element 33. Due to the specific geometry the liquid 24, if present, is also correspondingly separated or enlarged in surface and drained towards the top side 23*a* in a targeted way. Therein it is also already slowed down so that a hitting of the top side 23*a* no longer causes the liquid 24 to splash upward in an undesired strong way.

The liquid distribution element 33 can for instance be a cone or a pyramid or the like.

The liquid distribution element 33 is integrally formed with the bottom wall 23 and thus also integrally formed with the drip tray 16.

The drip tray 16 moreover has a grip element 25, which is preferably formed as a single piece and in particular also formed as a single piece with the drip tray 16. The grip element 15 is formed in the drip well 17 and ends both in the front side boundary wall 20 of the drip well 17 as well as in the top side 23*a* of the bottom wall 23. The grip element 25 is configured T-shaped and ends with a T-stem 26 in the front boundary wall 20 facing a niche opening 12. A T-roof 27 faces the rear boundary wall 19 and in the depth direction (z direction) ends in front of the liquid distribution element 33 and is arranged adjacent thereto.

In FIG. 4 it moreover can be seen that the niche 12 in the bottom portion has an at least slightly tray-like receptacle, into which the drip tray 16 is inserted.

In FIG. 5 the drip tray 16 is shown in a perspective view from the top. It can be seen both in FIG. 4 and in FIG. 5 that in the height direction (y direction) the grip element 25 extends fully within the height of the drip well 17 and thus does not protrude upward. The drip tray 16 at its top portion of the drip well 17 has a pedestal 28, on which a cover grid (not shown) that is separate therefrom can be placed. By this cover grid the drip well 17 is covered from the top in a grid-like manner and the receptacle can be put up on this cover grid.

Figure 6:
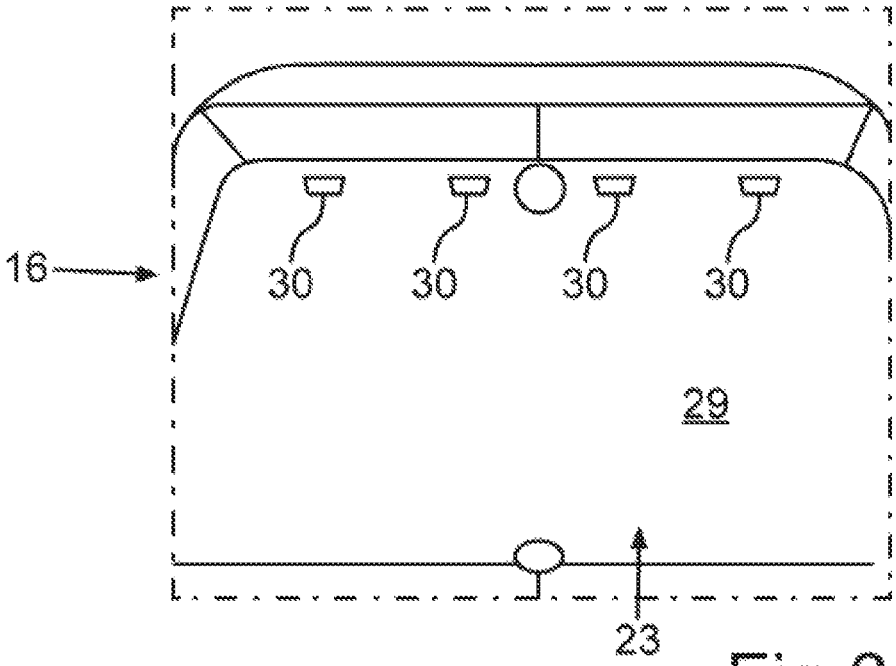
FIG. 6 is an illustration of a partial area of the drip tray showing a view of a bottom side.

In FIG. 6 the drip tray 16 is shown in a partial section from the bottom. Here a bottom side 29 of the bottom wall 23 facing away from the drip well 17 is shown. Moreover it can be seen that in this bottom side 29 at least one coupling element 30, in the embodiment several coupling elements 30, are integrated. The coupling elements 30 here are shown as recesses, into which counter coupling elements can engage in the inserted state of the drip tray 16 into the insert 6.

Figure 7:
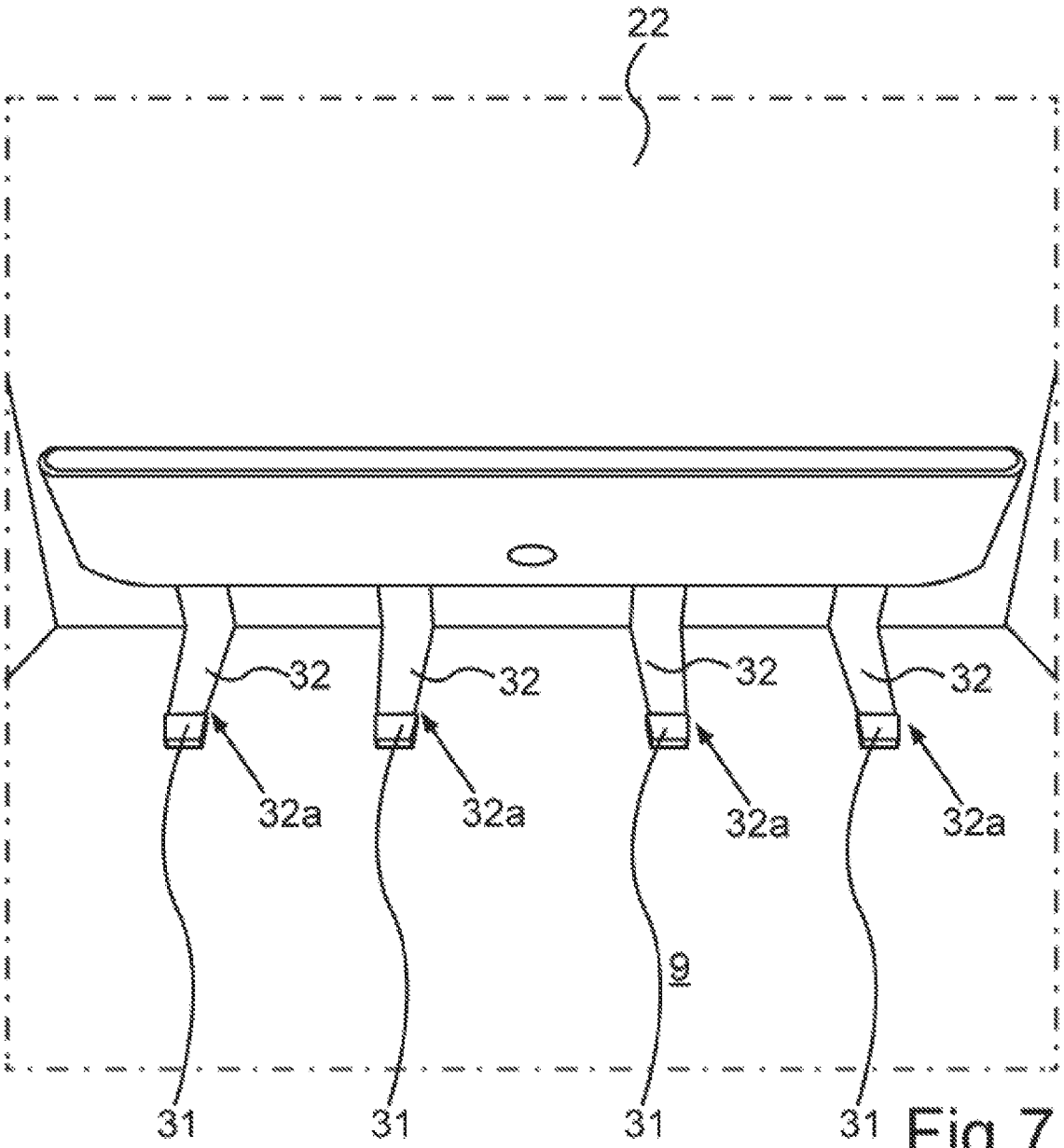
FIG. 7 is an illustration of a partial area of the insert according to FIG. 3.

In FIG. 7 in this connection, in terms of numbers equally to be understood as example, counter coupling elements 31 are shown, which are configured to be integrated into the bottom wall 9 of the insert 6. These counter coupling elements 31 are coupling pins extending upward, which preferably are configured to be equal in geometry with the recesses so that here an in particular also precisely fitting insertion of the counter coupling elements 31 into the coupling elements 30 can be effected.

As is shown in FIG. 7 in an enlarged view, in the insert 6 a plurality of slots 32 are formed in the bottom wall 9. These uninterrupted slots 32 facilitate that liquid running from the cover 22 and/or from the rear wall 11 and/or from the side walls 7 and 10 can be drained from the insert 6. This means that no liquid can collect under the drip tray 16 and thus between the drip tray 16 and the bottom wall 9. Through these slots 32 this liquid thus is also drained via the bottom wall 9 from the insert.

It is to be seen that the slots 32 viewed in the depth direction (z direction) are narrowing towards the front.

Preferably the counter coupling elements 31 are arranged as front side boundaries of these slots 32 and thus are arranged on the front ends 32*a* of the slots 32 facing the niche opening 12*a* of the niche 12.

In particular it is envisaged that these slots 32 are configured to be uninterrupted slots and thus continue without interruption also up into the rear wall 11 of the insert 6. In FIG. 7 in this connection also the cover 22 is arranged. In FIG. 7 an enlarged view of the representation I in FIG. 3 is shown.

The following is a summary list of reference numerals and the corresponding structure used in the above description of the invention:

1 household cooling appliance
2 housing
3 door
4 dispenser unit
5 recess
6 insert
7 wall
8 niche ceiling wall
9 wall
10 wall
11 wall
12 niche
12*a* niche opening
13 receptacle
14 decorative plate
15 recess
16 drip tray
17 drip well
18 boundary wall
19 boundary wall
20 boundary wall
21 boundary wall
22 cover
23 bottom wall
23*a* top side
24 liquid
25 grip element
26 T stem
27 T roof
28 pedestal
29 bottom side
30 coupling elements
31 counter coupling elements
32 slots
32*a* front end
33 liquid distribution element

The invention claimed is:

1. A household cooling appliance, comprising:

a dispenser for dispensing a liquid and/or a free flow refrigerated good, said dispenser containing:

an insert having side walls and a bottom wall bounding a niche, into said niche a receptacle can be inserted for receiving the liquid to be dispensed and/or the free flow refrigerated good; and a drip tray being separate from said insert, for collecting the liquid, said drip tray having a drip well and a grip extending within said drip well and being accessible from a top for gripping, said drip tray having a front boundary wall laterally bounding said drip well;

said grip having a substantially T-shaped cross section as viewed from above said drip tray, said grip protruding from said front boundary wall into said drip well.

2. The household cooling appliance according to claim 1, wherein:

said drip tray has a rear boundary wall laterally bounding said drip well; and said grip has a stem and a roof for defining the T-shaped cross section, said roof has a surface directed away from said stem that faces said rear boundary wall and faces away from a niche opening of said niche.

3. The household cooling appliance according to claim 1, wherein said grip is formed as a single piece with said front boundary wall.

4. The household cooling appliance according to claim 1, wherein:

said drip well has a bottom wall; and said grip is formed as a single piece with said bottom wall bounding said drip well.

5. The household cooling appliance according to claim 1, wherein said grip viewed across its entire height is disposed within said drip well.

6. The household cooling appliance according to claim 1, further comprising a cover grid, said drip well and said grip are covered by said cover grid that is capable of being removed from said drip tray.

7. The household cooling appliance according to claim 1, wherein:

said insert has a counter coupler;

said drip tray has a bottom wall with a bottom surface; and said bottom surface has at least one coupler, said coupler positions said drip tray in said insert and is configured to couple with said counter coupler on said insert.

8. The household cooling appliance according to claim 1, wherein:

said drip well has a bottom wall; and said drip tray at a top side of said bottom wall of said drip well has at least one liquid distribution element, said liquid distribution element elevated from said top side protrudes upwards and is configured to be narrowing from said top side upwards.

9. The household cooling appliance according to claim 1, wherein said front boundary wall is provided with a pedestal for supporting a cover grid of said drip well, said pedestal having a lower height than said front boundary wall, said grip having a lower height than said pedestal.

10. The household cooling appliance according to claim 9, wherein said pedestal is disposed between said front boundary wall and said grip.

11. A household cooling appliance, comprising:

a dispenser for dispensing a liquid and/or a free flow refrigerated good, said dispenser containing:

an insert having side walls and a bottom wall bounding a niche, said niche for receiving a receptacle for the liquid to be dispensed and/or the free flow refrigerated good; and a drip tray, being separate from said insert, for collecting the liquid, said drip tray having a bottom wall and boundary walls for defining a drip well;

a pedestal adjacent said boundary walls for supporting a cover grid of said drip well, said pedestal standing less proud of said bottom wall than said boundary walls;

a grip extending within said drip well and being accessible from a top for gripping between two fingers, said grip standing less proud of said bottom wall than said pedestal, said grip having a substantially T-shaped cross section as viewed from above said drip tray.

12. A household cooling appliance, comprising:

a dispenser for dispensing a liquid and/or a free flow refrigerated good, said dispenser containing:

an insert having side walls and a bottom wall bounding a niche, into said niche a receptacle can be inserted for receiving the liquid to be dispensed and/or the free flow refrigerated good; and a drip tray being separate from said insert, for collecting the liquid, said drip tray having a drip well and a grip extending within said drip well and being accessible from a top for gripping, said drip tray having a front boundary wall laterally bounding said drip well;

said grip having a substantially T-shaped cross section as viewed from above said drip tray.

* * * * *